United States Patent [19]

Darvas

[11] Patent Number: 5,054,124

[45] Date of Patent: Oct. 8, 1991

[54] HAIR CUTTING CAPE KIT WITH CAPE AND PAD MEMBERS UTILIZING ADHESIVE TO SEAL AND REMOVE HAIR CLIPPINGS

[76] Inventor: Robert L. Darvas, 4601 N. Via Entrada Apt. 2010, Tucson, Ariz. 85718

[21] Appl. No.: 577,199

[22] Filed: Sep. 4, 1990

[51] Int. Cl.[5] ..... A41D 13/00

[52] U.S. Cl. ..... 2/50; 2/174

[58] Field of Search ..... 2/46, 48, 50, 51, 174, 2/2, 49 R; 15/104 A

[56] References Cited

U.S. PATENT DOCUMENTS

| | | | |
|---|---|---|---|
| 1,723,018 | 8/1929 | Dunlap | 2/50 |
| 1,974,237 | 9/1934 | Eidinger | 2/50 |
| 2,093,483 | 9/1937 | Sackett | 2/50 |
| 2,110,544 | 3/1938 | Dauphin | 2/50 |
| 2,289,526 | 7/1942 | Tapper | 2/50 |
| 2,364,568 | 12/1944 | Tiscornia | 2/49 A |
| 2,544,487 | 3/1951 | Caluthis | 2/50 |
| 2,851,690 | 9/1958 | Jennings | 2/50 |
| 2,882,529 | 4/1959 | Argo | 2/50 |
| 3,389,416 | 6/1968 | Tumms | 15/104 A |
| 3,501,797 | 3/1970 | Nappi | 15/104 A |
| 3,949,875 | 4/1976 | Catania et al. | 206/390 |
| 4,646,364 | 3/1987 | O'Larey | 2/49 |
| 4,689,830 | 9/1987 | Williams | 2/50 |
| 4,710,980 | 12/1987 | Brison et al. | 2/50 |
| 4,713,274 | 12/1987 | Minor | 15/104 A X |

FOREIGN PATENT DOCUMENTS

| | | | |
|---|---|---|---|
| 0373824 | 6/1990 | European Pat. Off. | 2/50 |
| 412674 | 8/1924 | Fed. Rep. of Germany | 2/50 |
| 812696 | 7/1951 | Fed. Rep. of Germany | 2/50 |
| 812273 | 6/1951 | Fed. Rep. of Germany | 2/50 |
| 1496525 | 9/1967 | France | 2/50 |
| 8403838 | 7/1986 | Netherlands | 15/104 A |
| 1330126 | 9/1973 | United Kingdom | 15/104 A |
| 2138673 | 10/1984 | United Kingdom | 15/104 A |
| 2220557 | 1/1990 | United Kingdom | 2/49 R |

*Primary Examiner*—Werner H. Schroeder
*Assistant Examiner*—Jeanette E. Chapman
*Attorney, Agent, or Firm*—Victor Flores

[57] ABSTRACT

The present invention teaches a hair cutting accessory in the form of a cape and pat-down pads that utilize respective adhesive surfaces for collecting hair clippings that result during a hair cutting service. The cape is adapted with a collar member for draping around a person's neck area and is formed having a peelable backing for covering an adhesive strip surface of sufficient width to form two usable adhesive portions. The first adhesive portion is used to adhesively attach to a patron's neck area for creating a seal around the neck for preventing hair clippings from entering beneath the cape. The second adhesive portion is intended to be left exposed around the neck area for readily and adhesively collecting any fallen hair clippings. Each pat-down pad is sized to be hand held and is also formed having a peelable backing for covering an adhesive surface until ready to use. By peeling the backing, covering the adhesive surface, the pads can be utilized to pat-down the patron's neck area and or gently rub through the patron's uncut hair to collect any remaining hair clippings.

6 Claims, 2 Drawing Sheets

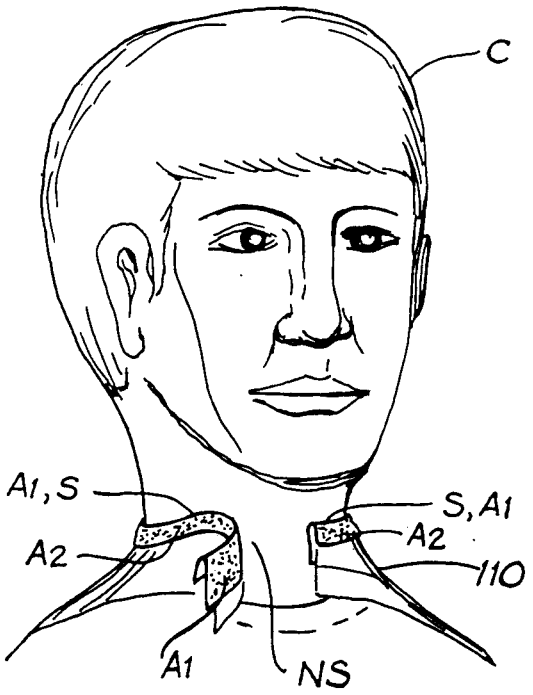
FIG. 4A
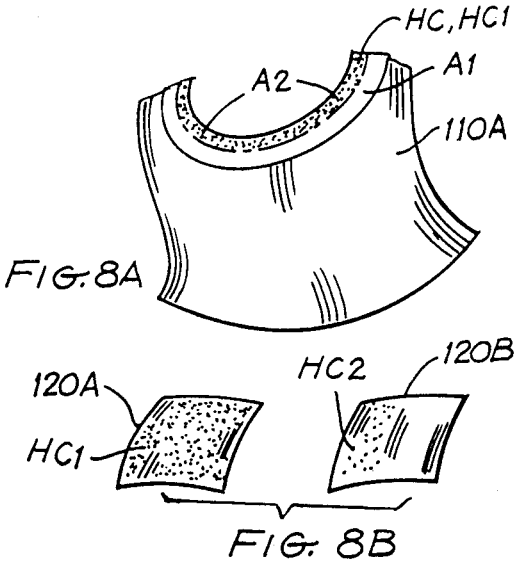
FIG. 8A
FIG. 8B
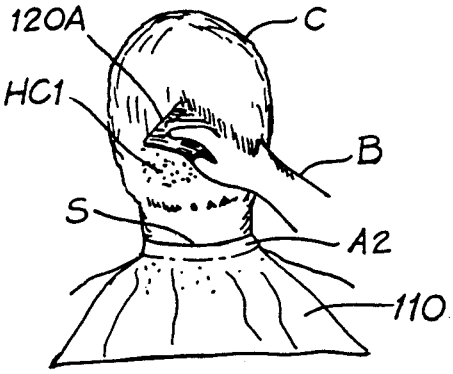
FIG. 6
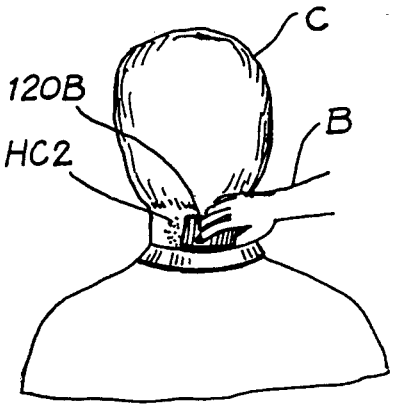
FIG. 7

HAIR CUTTING CAPE KIT WITH CAPE AND PAD MEMBERS UTILIZING ADHESIVE TO SEAL AND REMOVE HAIR CLIPPINGS

FIELD OF THE INVENTION

This invention relates to hair cutting accessories. More particularly, the present invention relates to hair cutting accessories that are used to collect hair clippings during a hair cutting session for purposes of keeping hair clippings from contacting and annoying the person receiving the hair cutting services. Even more particularly, the present invention relates to hair cutting accessories that utilize adhesives for collecting hair clippings during a hair cutting service and that serves to minimize hair clippings from remaining on the person's neck area and causing annoyance.

DESCRIPTION OF THE PRIOR ART

It is known to provide capes and accessories, such as vacuums, for collecting hair clippings during a haircutting session, as a means of minimizing related annoyance to a person receiving hair cutting services. The sincere efforts of hair dressers and barbers to prevent annoyance is effective only to the extent that the capes and accessories which are used, maximize contact with the hair clippings, which clippings include hair particles of varying sizes. The neckline area is the most likely area of intercepting the fallen hair clippings to prevent their entry beyond the cape and onto the person's upper body where the annoyance is typically encountered. The normal procedure typically involves preparing a patron by placing a fabric barrier at the neckline in attempts to seal the upper body from the fallen hair clippings. The next step generally involves placement of another outer cape as a first means of collecting the fallen hair clippings. The hair cutting session takes place, vacuuming, brushing, or the like is performed to remove the hair clippings, with the inadvertent result that hair clipping particles remained to cause annoyance, typically some time after the patron has left the barber shop or beauty shop establishment. The most likely reason being that the barrier at the neckline did not effectively seal or intercept the fallen hair clippings.

U.S. Pat. Nos. 4,710,980, 4,689,830, 4,646,364 and 3,949,875 are examples of known prior art that relate to the problem of collecting hair clippings or otherwise relate to the preparation of a patron for receiving hair cutting or similar services. While these patented devices are suited for their intended purpose, they do not address the overall hair clipping annoyance problem related to the receipt of hair cutting services, especially annoyance resulting sometime subsequent to receipt of the hair cutting services.

Thus, a need is seen to exist for an apparatus that will effectively intercept falling, or otherwise cut hair particles, or clippings and that will also create an effective barrier that seals the patron's upper body from the fallen hair clippings and that maximizes the collection of hair clippings and thus minimizes related annoyance subsequent to receipt of hair cutting services.

SUMMARY OF THE INVENTION

Accordingly, the primary object of the present invention is to provide an apparatus comprising hair clippings collecting means having adhesive surface means for effecting maximum adherence and collection of hair clippings.

It is a more particular object of the present invention to provide an apparatus comprising cape means having a collar member for draping around a person's neck area, said collar member having an adhesive surface for effecting said adherence and collection of said hair clippings and for adhesively attaching to a neck area of a person receiving hair cutting services and for preventing hair clippings from entering beneath upper body clothing and contacting the person's skin and thus minimizing related hair clippings contact annoyance during and subsequent to receiving the hair cutting services.

It is yet another object of the present invention to provide in combination with the foregoing objects at least one pat-down pad means provided with an adhesive surface for further effecting said maximum adherence and collection of said hair clippings.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

BRIEF DESCRIPTION OF THE DRAWINGS

FIG. 4A is a frontal view of the customer being prepared for hair cutting services and illustrating adhesive strip on the collar portion of the cape encircling the neck being gently adhered to the neck to form a seal and the exposed portion of the adhesive for collecting hair clippings.

FIG. 6 is a backside view of a customer after receiving a hair cut and at an initial stage of clean-up, illustrating one of the adhesive surface-lined pat-down pads being used on the uncut hair for purposes of adhesively gathering hair clippings remaining among the uncut hair.

FIG. 7 is a backside view of a customer after receiving a hair cut at a final stage of clean-up, illustrating the utilization of another one of the pat-down pads to adhesively gather any remaining hair clippings on the person's neck area.

FIG. 8A is a view of the used cape illustrating the hair clippings adhered to the exposed adhesive strip portion and the clean adhesive portion sealing the neck area.

FIG. 8B is a view of the used pat-down pads, illustrating the hair clippings adhered to the adhesive surfaces in different amounts depending upon whether used for initial or final clean-up.

DESCRIPTION OF THE PREFERRED EMBODIMENT

Figure 4:
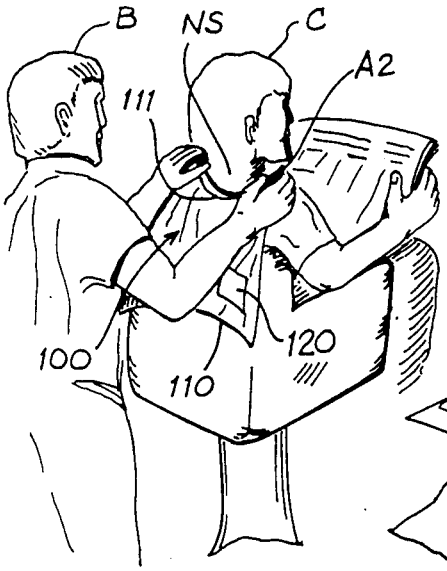
FIG. 4 is a perspective view of a customer seated at a barber's chair being caped with the present invention in preparation for receiving hair cutting services.
Figure 1:
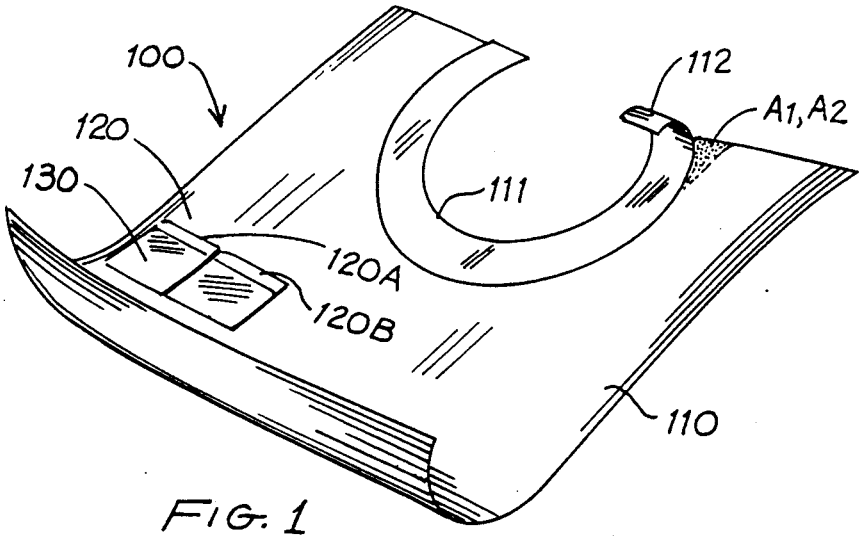
FIG. 1 is an underside view of the present invention illustrating the partially peeled backing exposing the adhesive strip on the collar portion of the cape as well as a pair of detachable hair clippings pat-down pads.
Figure 2:
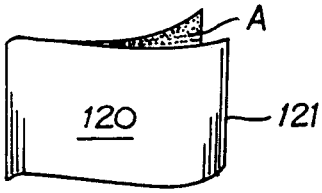
FIG. 2 is a perspective view of the pat-down pads illustrating the peelable backing and adhesive surface for use at various clean-up stages of the hair cutting services.

Referring first to FIG. 1 where the present invention 100 is shown in kit form comprising a cape member 110 and detachable plurality of pat-down pads 120 held in a pocket part 130. Cape member 110 is shown having a collar portion 111 having a peelable backing 112 covering an adhesive strip of sufficient width to form two usable adhesive portions A1 and A2. As best seen in FIG. 4A, adhesive portion A1 is used to adhesively attach to a patron's skin around the neck area NS and create a seal S to prevent hair clippings from entering beneath the cape, see also FIG. 4. Also as best seen in FIG. 4A, adhesive portion A2 is intended to be left exposed around the neck area NS for readily and adhesively collecting any fallen hair clippings HC, see also FIG. 5. By example, pat-down pads 120, as shown in FIG. 1, are conveniently attached as pairs 120A and 120B to a portion of cape 110. Each pad 120, 120A, 120B, etc, is as illustrated in FIG. 2, comprised of peelable backing 121 and adhesive surface A for use at various clean-up stages of performing a hair cutting service.

Figure 3:
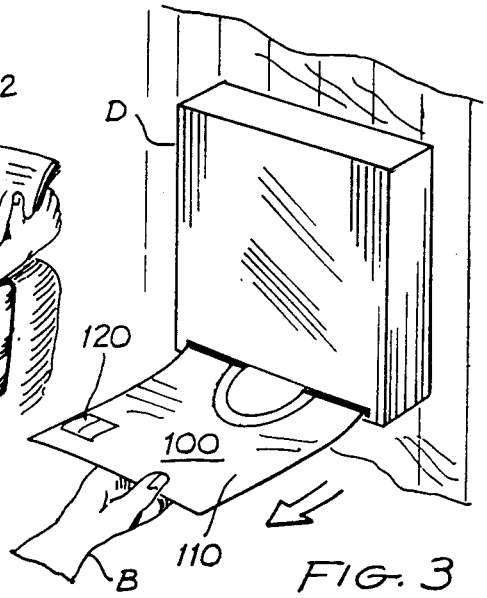
FIG. 3 is a perspective view of the present invention illustrating a suggested manner of dispensing at a place providing hair cutting services.
Figure 5:
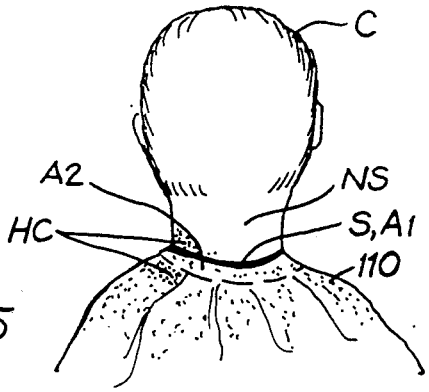
FIG. 5 is a backside view of a customer during a hair cutting sitting, illustrating hair clippings sealed at the neckline by the adhesive collar and prevented from entering and contacting the body beneath the clothing and collected hair clippings on the exposed adhesive portion.

In operation, and by example, a barber B dispenses the present invention 100 from dispenser D as shown in FIG. 3, and drapes a patron C as shown in FIG. 4 in preparation for receiving hair cutting services. As discussed previously, the patron being prepared for hair cutting services is firstly draped around the neck area NS utilizing the adhesive strip A1 on the collar portion to form a seal S around C's neck. Once the seal is effected using adhesive portion A1, the remaining adhesive portion A2 is left exposed to freely collect any fallen hair clippings HC. Thus, during the hair cutting session, and as illustrated in FIG. 5, hair clippings HC are sealed off at the neckline by the adhesive portion A1 and prevented from entering and contacting the body beneath the clothing. Further, the exposed adhesive portion A2 is free to collect any fallen hair and hair clippings. At the option of barber B, an outer cape, not shown, may be utilized to keep from subjecting cape 110 from a majority of the fallen hair clippings HC. If the outer cape is used the exposed adhesive portion A2 would serve as an underlying interceptive adhesive barrier to collect hair clippings not intercepted by the outer cape.

Having received the hair cutting services with the sealed neckline area, barber B can continue with the precautionary procedure of keeping hair clippings from later annoying patron C by utilizing one of the pat-down pads 120, by example 120A. As shown in FIG. 6 the patron C receives an initial stage of clean-up, using the adhesive surface-lined pat-down pads 120A on the uncut hair and the neck area for purposes of adhesively gathering any hair clippings HC1 remaining among the uncut hair and the neck area that were not collected on the exposed adhesive portion A2. Once the first stage of clean-up is performed the soiled cape member 110 is gently removed from the patron's neck and discarded along with the first used 120A, or as many pads 120 as were required to collect the hair clippings HC1. As shown in FIG. 7, barber B can perform a final stage of clean-up utilizing another one of the pat-down pads, by example 120B, to adhesively gather any remaining hair clippings HC2 on the person's neck area and thus maximize the collection of hair clippings and minimize related subsequent annoyance. FIG. 8A shows a soiled cape 110A illustrating the hair clippings HC, HC1 adhered to the adhesive strip portion A2 and the clean adhesive portion A1 sealing the neck area. FIG. 8B shows first used pat-down pad 120A and second or final clean-up stage used pat-down pad 120B illustrating the different amount of hair clippings HC1 and HC2, respectively, collected at the two stages of clean-up.

Therefore, while the present invention has been shown and described herein in what is believed to be the most practical and preferred embodiments, it is recognized that departures can be made therefore within the scope of the invention, which is therefore not to be limited to the details disclosed therein but is to be accorded the full scope of the claims so as to embrace any and all equivalent apparatus.

I claim:

1. A hair cutting accessory apparatus, said apparatus comprising:

cape means having a collar member for draping around a person's neck area, said collar member comprising a first adhesive surface for effecting adherence and collection of hair clippings and a second adhesive surface for adhesively attaching to a neck area of a person receiving hair cutting services, said second adhesive surface being used for preventing said hair clippings from entering beneath said person's upper body clothing and contacting said person's skin and thereby aid in eliminating related hair clippings contact annoyance; and at least one pat-down pad means provided with an adhesive surface for further effecting said adherence and collection of said hair clippings, said cape means and said at least one pat-down pad comprise a hair cutting unit accessory, said at least one pat-down pad being detachably secured to said cape means.

2. A hair cutting accessory apparatus as recited in claim 1, wherein said hair cutting unit accessory comprises a dispensable, detachable unit member of a plurality of similar hair cutting unit accessories.

3. A hair cutting accessory apparatus, said apparatus comprising:

cape means having a collar member for draping around a person's neck area, said collar member having an adhesive surface for effecting adherence and collection of hair clippings and for adhesively attaching to a neck area of a person receiving hair cutting services and for preventing said hair clippings from entering beneath said person's upper body clothing and contacting said person's skin and thereby aid in eliminating related hair clippings contact annoyance; and at least one pat-down pad means provided with an adhesive surface for further effecting said adherence and collection of said hair clippings, said cape means and said at least one pat-down pad comprise a hair cutting unit accessory, said at least one pat-down pad being detachably secured to said cape means, and said adhesive surfaces on said collar member and said pads having a respective detachable backing for preserving respective adhesive surfaces in a ready to use condition.

4. A hair cutting accessory apparatus as recited in claim 3, wherein said hair cutting unit accessory comprises a dispensable, detachable unit member of a plurality of similar hair cutting unit accessories.

5. A method of collecting hair clippings and preventing related skin contact annoyance subsequent to receiving hair cutting services, said method comprising:

(a) providing a hair cutting unit accessory apparatus, said apparatus comprising:

cape means having a collar member for draping around a person's neck area, said collar member having an adhesive surface for effecting adherence and collection of said hair clippings and for adhesively attaching to a neck area of a person receiving hair cutting services and for preventing said hair clippings from entering beneath said person's upper body clothing and contacting said person's skin and thereby aid in eliminating related hair clippings contact annoyance, and at least one pat-down pat means provided with an adhesive surface for further effecting said adherence and collection of said hair clippings, said cape means and said at least one pat-down pad means comprise a hair cutting unit accessory, said at least one pat-down pad means being detachably secured to said cape means;

(b) adhesively attaching said collar member to a person's neck area utilizing a portion of said adhesive surface on said collar member and inherently creating a seal that will prevent hair clippings from entering beyond and beneath said cape means;

(c) cutting said person's hair; and (d) adhesively collecting minute hair clippings falling onto another portion of said adhesive surface on said collar member proximate said seal.

6. A method of collecting hair clippings as recited in claim 5, wherein said method further comprises the step of:

(e) detaching said at least one pat-down pad means from said cape means and patting said person's neck and uncut hair as a first stage of clean-up after receiving said hair cutting services;

(f) detaching any remaining ones of said at least one pat-down pad means from said cape means and removing and discarding said cape and said pat-down pad having said adhesively collected hair clippings; and (g) patting said person's neck and uncut hair with another one of said at least one pat-down pad means as a final stage of clean-up after receiving said hair cutting services.

* * * * *